US006125501A

United States Patent [19]

Yip

[11] Patent Number: 6,125,501

[45] Date of Patent: Oct. 3, 2000

[54] VACUUM CLEANER USING A SHEET FILTER

[76] Inventor: Chung Lun Yip, 3rd Floor, Blocks A & C, King Yip Factory Building, No. 59 King Yip Street, Kwun Tong Kowloon, The Hong Kong Special Administrative Region of the People's Republic of China

[21] Appl. No.: 09/227,582

[22] Filed: Jan. 8, 1999

[51] Int. Cl.[7] ..... A47L 9/10

[52] U.S. Cl. ..... 15/344; 15/352; 55/503; 55/DIG. 3

[58] Field of Search ..... 15/344, 352; 55/503, 55/DIG. 3

[56] References Cited

U.S. PATENT DOCUMENTS

| | | | |
|---|---|---|---|
| 3,111,489 | 11/1963 | Getzin | 55/503 |
| 3,252,580 | 5/1966 | Getzin | 55/503 |
| 3,950,157 | 4/1976 | Matney | 55/503 |
| 4,099,944 | 7/1978 | Davis | 55/503 |
| 4,213,224 | 7/1980 | Miller | 15/344 |
| 4,342,133 | 8/1982 | Minton | 55/DIG. 3 |
| 4,460,394 | 7/1984 | Wrightson | 55/503 |
| 4,577,365 | 3/1986 | Yuen | 15/344 |
| 5,685,894 | 11/1997 | Bowerman et al. | 55/DIG. 3 |
| 5,938,410 | 8/1999 | Lee | 15/344 |

*Primary Examiner*—Robert J. Warden, Sr.
*Assistant Examiner*—Theresa T. Snider
*Attorney, Agent, or Firm*—Leydig, Voit & Mayer, Ltd

[57] ABSTRACT

A vacuum cleaner includes a body having an inlet and an outlet and an internal path for air from the inlet to the outlet, a fan in the path, and an electric motor for driving the fan to create a flow of air along the path. The vacuum cleaner includes first and second apertured support members in the path at a position upstream of the fan for supporting a sheet of flexible filter material between them in a substantially fixed manner.

12 Claims, 3 Drawing Sheets

VACUUM CLEANER USING A SHEET FILTER

BACKGROUND OF INVENTION

Conventional vacuum cleaners require the use of specific filter bags supplied by the original manufacturers, which are expensive. Their supply for old vacuum cleaner models may stop too soon, which limits the usage life of such vacuum cleaners.

The present invention seeks to solve the aforesaid problems by providing a vacuum cleaner capable of using filter material that is readily available.

SUMMARY OF INVENTION

According to the invention, there is provided a vacuum cleaner which comprises a body having an inlet and an outlet and providing an internal path for air from the inlet to the outlet, a fan provided in the path, an electric motor for driving the fan to create a flow of air along the path, and first and second apertured support members provided in the path at a position upstream of the fan for supporting a sheet of flexible filter material between them in a substantially fixed manner.

Preferably, the support members have matching surface profiles and are arranged to sandwich the sheet of filter material between them.

More preferably, the support members have substantially flat surface profiles.

In a preferred embodiment, each support member has a lattice portion providing a plurality of apertures.

More preferably, the lattice works of the support members substantially coincide with each other.

It is preferred that the majority of the apertures of the support members are substantially square in shape.

In a specific construction, the body has an opening having a protruding rim and the first support member has a peripheral flange for surrounding the rim in order to cover the opening.

More specifically, the second support member is held in position by the first support member against the opening.

Further more specifically, the second support member is received within the rim of the opening.

It is preferred that the first support member includes snap-fit parts for releasable engagement with the body.

The vacuum cleaner may be a hand-held vacuum cleaner.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
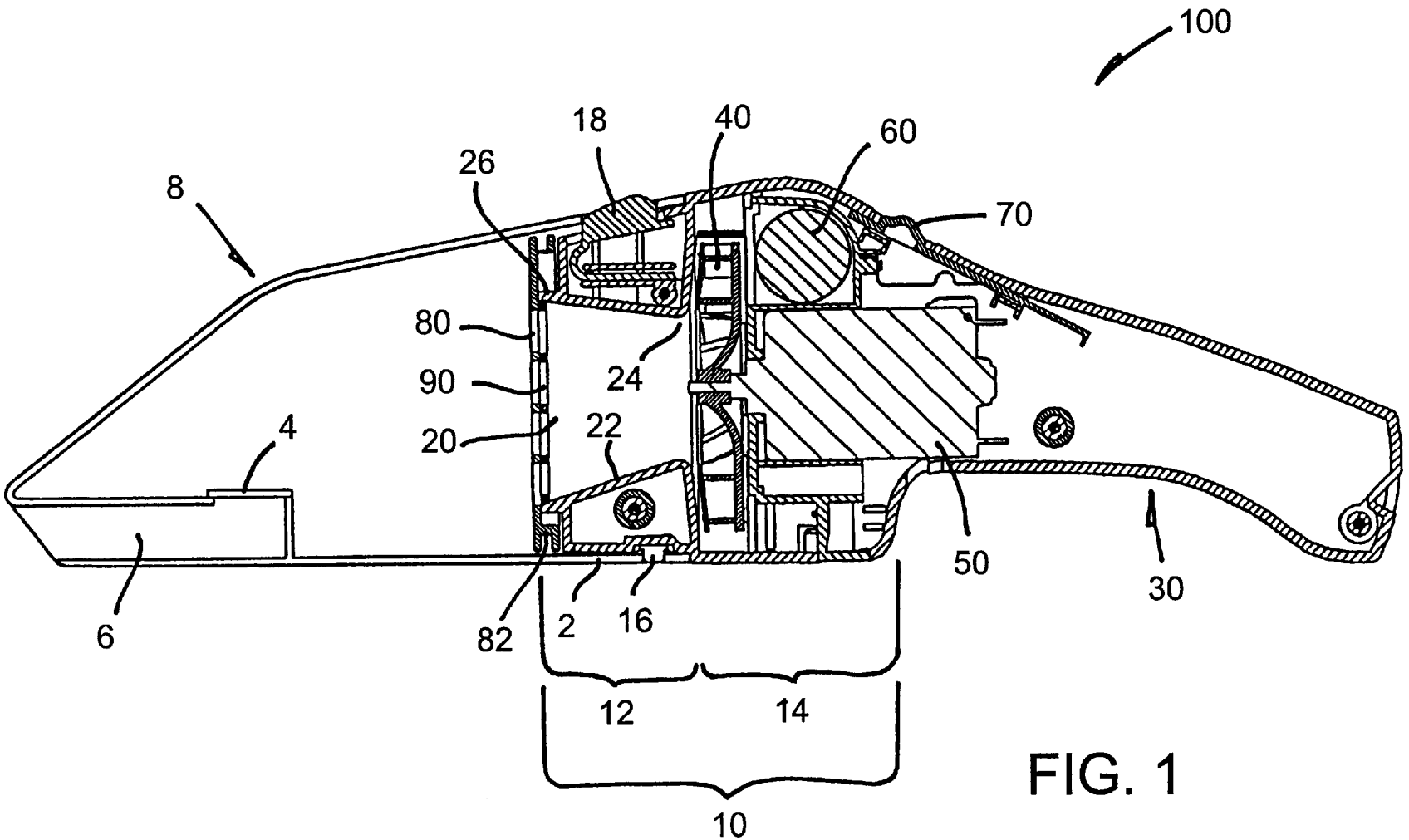
FIG. 1 is a cross-sectional left side view of an embodiment of a vacuum cleaner in accordance with the invention.
Figure 2:
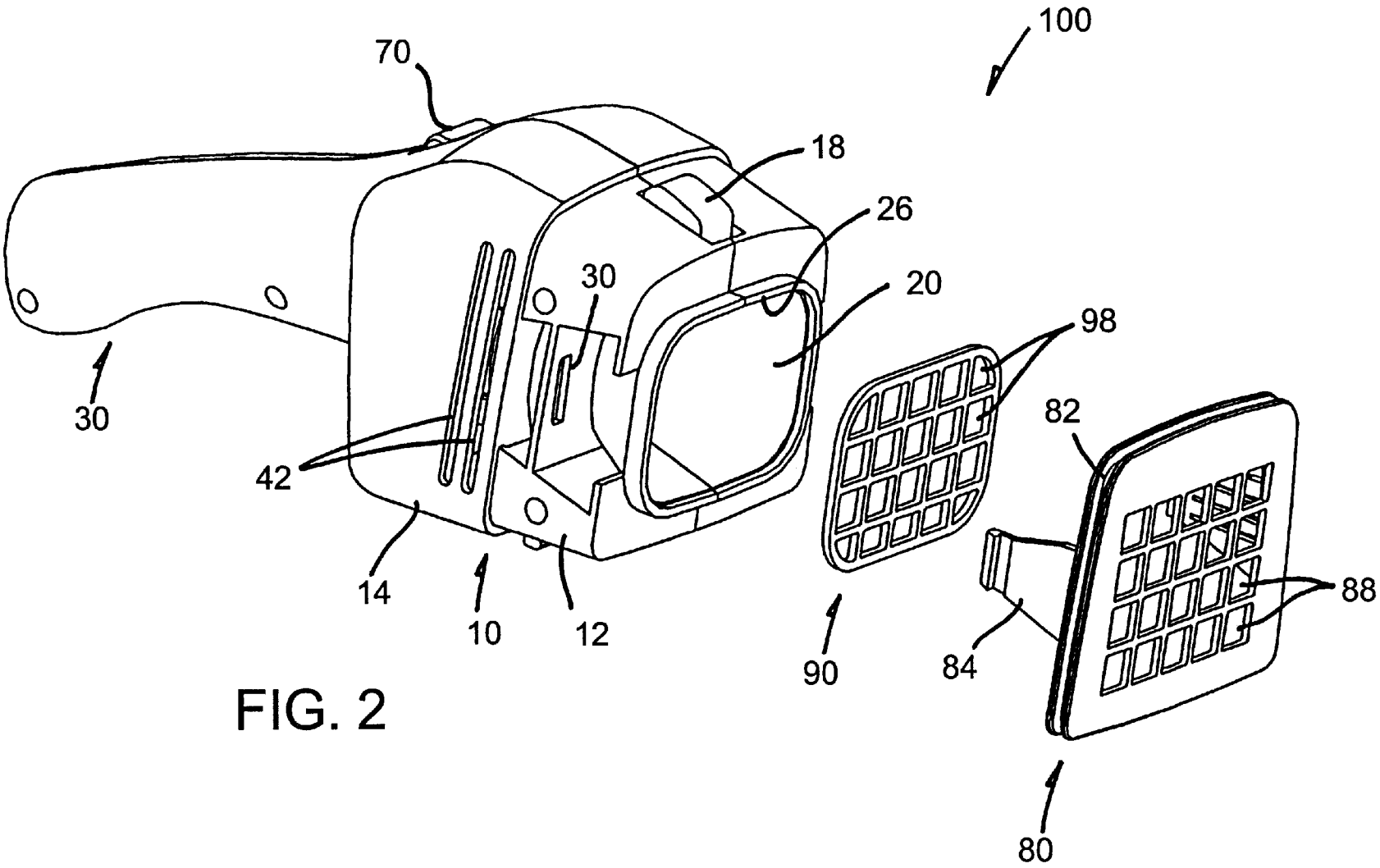
FIG. 2 is a front end and right side perspective view of a body of the vacuum cleaner of FIG. 1.
Figure 3:
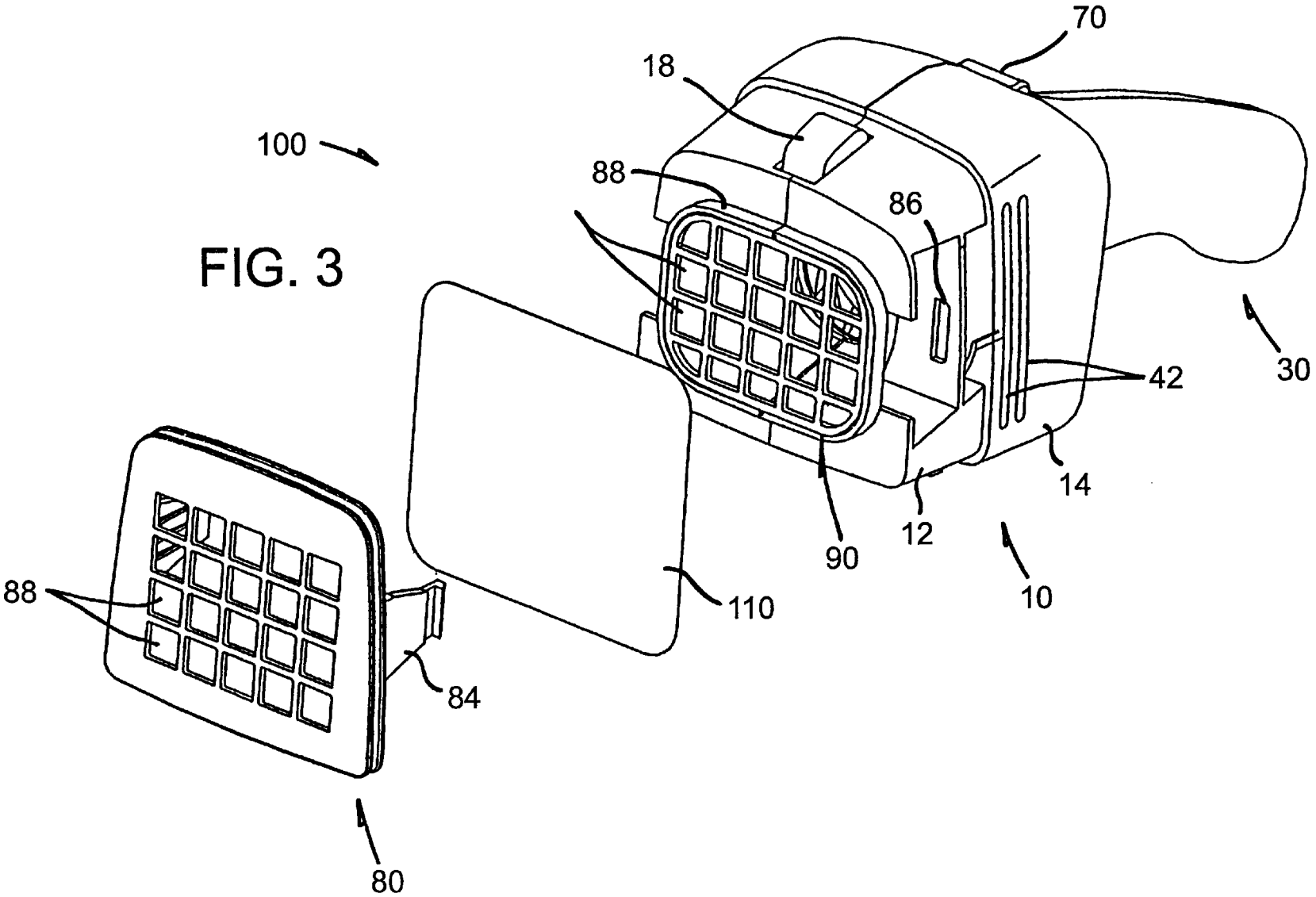
FIG. 3 is a front end and left side perspective view of the vacuum cleaner body of FIG. 2.

Referring to the drawings, there is shown a hand-held vacuum cleaner 100 embodying the invention, which vacuum cleaner 100 comprises a plastic main body 10 having a generally square opening 20 on the front side and an integral handle 30 protruding from the rear side. The body 10 has integral front and rear parts 12 and 14. The vacuum cleaner 100 includes a centrifugal fan 40 and an electric motor 50 for driving the fan 40, both of which are contained inside the rear body part 14 and extend along a central axis passing through the front opening 20. The motor 50 is powered by an adjacent rechargeable battery cell 60 under the control of a slide switch 70 provided on the upper side of the body 10 near the handle 30. A pair of air vents 42 is located on each of the left and right walls of the rear body part 14 on opposite sides of the fan 40.

The vacuum cleaner 100 includes a plastic tapered nozzle unit 8 which has a front end 6 provided with an internal flap valve 4 and a rear end 2 for releasable connection to and around the front body part 12 as a snap-fit. The snap-fit connection is effected by means of a bottom anchor 16 and a top spring-loaded locking knob 18 provided on the front body part 12. A central frusto-conical passage 22 is formed within the front body part 12, which has the front opening 20 at its larger end and a rear opening 24 at its smaller end. The rear opening 24 is aligned with and positioned close to the central air in-take part of the centrifugal fan 40. Thus, a path is formed for air which enters through the nozzle unit 8 (the inlet), travels along the passage 22 and then past the fan 40 and finally exits through the side vents 42 (the outlet).

The vacuum cleaner 100 further includes a dust tray 80 and a dust baffle 90, both of which are generally flat, square in shape and for use across the front opening 20 of the body 10, at a position upstream of the centrifugal fan 40. The front opening 20 has a protruding rim 26 which is an extension of the frusto-conical passage 22 to provide a seat for receiving the dust baffle 90 just inside as a close fit. The dust tray 80 has a short peripheral flange 82 and a pair of hooks 84 extending backwards on left and right sides. It acts like a cap to cover the front opening 20 (with the flange 82 surrounding the rim 26), thereby holding the dust baffle 90 against the opening 20. Two slots 86 are formed on opposite sides of the front body part 12. The dust tray 80 is held in position by having its hooks 84 releasably engaging through the respective slots 86.

The dust tray 80 and baffle 90 have respective flat central lattice portions, each providing an array of 4×5 apertures 88/98. Apart from the ones at the corners, the apertures 88 and 98 have the same shape and size, with the respective lattices in alignment or coinciding with each other. Before the dust tray 80 is fitted, a sheet of flexible filter 110 is laid over the dust baffle 90 extending across the front opening 20. With the dust tray 80 fitted, the filter 110 is sandwiched between, and thus held flat in position by, the dust tray 80 and the dust baffle 90. The debris, such as dust and the like, blocked by the filter 110 is collected in the removable nozzle unit 8 for subsequent disposal.

By reason of the uncomplicated arrangement of the dust tray 80 and baffle 90, any suitable material may be used to make the filter 110, such as paper, cloth, mesh nylon or the like. The lattices providing the apertures 88 and 98 also serve to protect the filter 110.

It is not necessary for the central lattice portions of the dust tray 80 and baffle 90 to have flat surface profiles, provided that the surface profiles match with each other and are able to hold a sheet of flexible filter material between them in a substantially fixed manner. In fact, a convex or concave profile for both the dust tray 80 and the dust baffle 90 will provide an extended or relatively larger filter area.

The invention has been given by way of example only, and various other modifications of and/or alterations to the described embodiment may be made by persons skilled in the art without departing from the scope of the invention as specified in the appended claims.

What is claimed is:

1. A vacuum cleaner comprising:

a body having an inlet, an outlet, and an internal path for air flow from the inlet to the outlet;

a fan located in the path;

an electric motor for driving the fan to create a flow of air through the path; and first and second apertured support members located in the path at a position upstream of the fan for supporting a sheet of flexible filter material between the first and second apertured support members, each of the first and second support members having a lattice including a plurality of apertures.

2. The vacuum cleaner as claimed in claim 1, wherein the first and second support members have matching surface profiles and are arranged to sandwich the sheet of filter material.

3. The vacuum cleaner as claimed in claim 2, wherein the first and second support members have substantially flat surface profiles.

4. The vacuum cleaner as claimed in claim 3, wherein the lattices of the first and second support members substantially coincide with each other.

5. The vacuum cleaner as claimed in claim 3, wherein the majority of the apertures of the first and second support members are substantially square.

6. The vacuum cleaner as claimed in claim 1, wherein the lattice of the first and second support members substantially coincide with each other.

7. The vacuum cleaner as claimed in claim 1, wherein a majority of the apertures of the first and second support members are substantially square.

8. A vacuum cleaner comprising:

a body having an inlet, an outlet, an internal path for flow of air from the inlet to the outlet, and an opening having a protruding rim;

a fan located in the path;

an electric motor for driving the fan to create a flow of air through the path; and first and second apertured support members located in the path at a position upstream of the fan for supporting a sheet of flexible filter material between the first and second support members, wherein the first support member has a peripheral flange surrounding the rim and covering the opening and the second support member is received within the rim and is held in position by the first support member against the opening.

9. The vacuum cleaner as claimed in claim 8, wherein each support member has a lattice including a plurality of apertures.

10. The vacuum cleaner as claimed in claim 9, wherein the lattices of the support members substantially coincide with each other.

11. The vacuum cleaner as claimed in claim 8, wherein a majority of the apertures of the first and second support members are substantially square.

12. The vacuum cleaner as claimed in claim 8, wherein the first support member includes snap-fit parts releasably engaging the body.

* * * * *